United States Patent [19]

Sundberg

[11] 4,047,859

[45] Sept. 13, 1977

[54] AXIAL VANE PUMP WITH NON-ROTATING VANES

[75] Inventor: Jack Gunnar Sundberg, Meriden, Conn.

[73] Assignee: Chandler Evans Inc, West Hartford, Conn.

[21] Appl. No.: 714,598

[22] Filed: Aug. 16, 1976

[51] Int. Cl.[2] ..... F04C 15/00; F04C 1/00

[52] U.S. Cl. ..... 418/232; 418/188; 418/217

[58] Field of Search ..... 418/188, 217, 219, 230, 418/232, 267, 249, 123

[56] References Cited

U.S. PATENT DOCUMENTS

| | | | |
|---|---|---|---|
| 420,347 | 1/1890 | Knebel et al. | 418/217 X |
| 974,913 | 8/1910 | Pittler | 418/217 X |
| 2,812,719 | 11/1957 | Nash | 418/217 |
| 2,902,942 | 9/1959 | Pelladeau | 418/219 X |
| 3,223,044 | 12/1965 | Adams et al. | 418/267 X |

FOREIGN PATENT DOCUMENTS

| | | | |
|---|---|---|---|
| 1,503,337 | 12/1971 | Germany | 418/217 |

*Primary Examiner*—Carlton R. Croyle
*Assistant Examiner*—Leonard Smith
*Attorney, Agent, or Firm*—Radford W. Luther; Richard A. Dornon

[57] ABSTRACT

A vane pump has a cam member carried upon a drive shaft in coaxial relationship therewith. The axial sides of the cam member define annular cam surfaces which each engage an array of vanes disposed in a fixedly mounted stator. An interior portion of the drive shaft is hollowed to provide a fluid inlet to passages in the cam member which communicate with the cam surfaces. The cam member is provided with additional passages to receive discharge flow from intervane volumes and direct such flow to the radially outer periphery of the cam member.

1 Claim, 5 Drawing Figures

AXIAL VANE PUMP WITH NON-ROTATING VANES

BACKGROUND OF THE INVENTION

This invention relates to pumps and more particularly to vane pumps.

In conventional vane pumps, a number of structural design constraints are placed upon the vanes because of the centrifugal force to which they are subjected. In addition, centrifugal force in such pumps occasions high bearing loads between the vanes and the cam surface, thereby increasing the power required to drive the pump.

For many applications, it is necessary to furnish a high pressure at the inlets of known gear and vane pumps for the effective charging thereof. Usually, this pressure is generated by a boost pump or an inducer. Obviously, it would be highly desirable to provide a gear or vane pump which did not require the utilization of a boost pump.

SUMMARY OF THE INVENTION

A vane pump of the invention incorporates stationary vanes which, of course, are not subjected to centrifugal force, whereby the vane design admits of numerous variations. In addition, a vane pump of the invention has a rotating inlet which may raise pump inlet pressure to such an extent that permits the elimination of boost pumps or other pressure increasing devices.

In brief, a pump of the invention comprises a cam member carried upon a hollow drive shaft in coaxial relationship therewith. At least one axial side of the cam member has an undulated cam surface fashioned thereupon. The cam surface is engaged by a plurality of vanes which are mounted within slots in a fixed stator for axial movement toward and away from the cam surface in the usual manner. The cam member is provided with inlet passage means which communicate with intervane volumes traversing an inlet arc and outlet passage means which communicate with intervane volumes traversing a discharge arc. The hollow drive shaft functions as an inlet passage for delivering fluid to the inlet passage means.

A pump of the invention is advantageous because the reduced loading between the non-rotating vanes and the cam surface permits wide variations in vane design. In addition, the rotating inlet passage means in the cam member raises the pressure of the fluid entering an intervane volume to such an extent that a boost pump or other pressure raising means may be obviated.

Accordingly, it is a primary object of the invention to provide a vane pump having non-rotating vanes and a rotating cam member.

Another object is to provide a vane pump which inherently raises the fluid inlet pressure prior to delivery to an intervane volume.

A further object is to provide a vane pump wherein the vanes are subjected to minimum loading against the cam surface.

These and other objects and advantages of the iven-tion will become more readily apparent from the following detailed description, when taken in conjunction with the accompanying drawings, in which:

DETAILED DESCRIPTION OF PREFERRED EMBODIMENT

Figure 1:
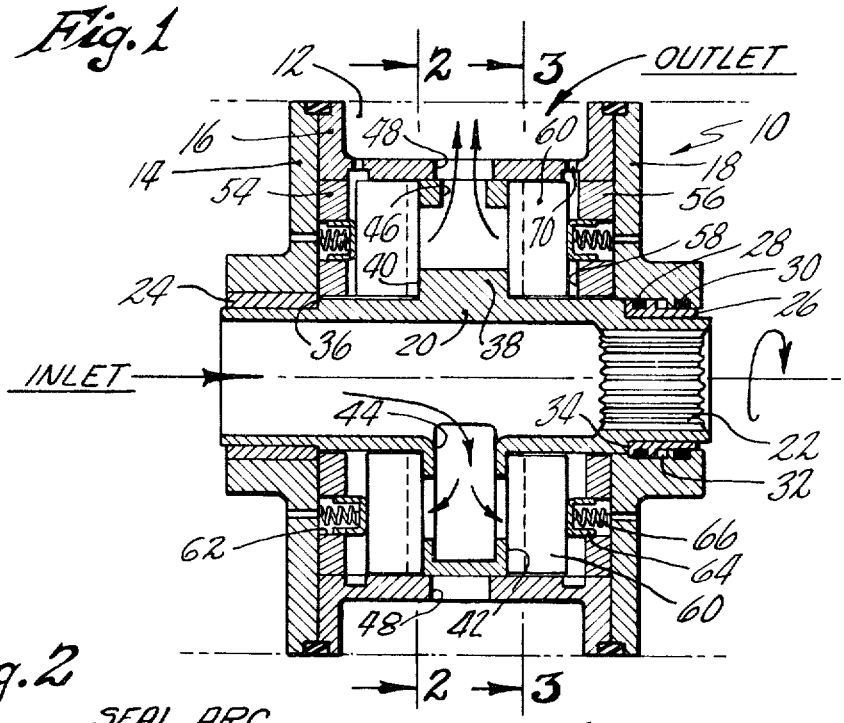
FIG. 1 is a longitudinal sectional view of a pump of the invention, taken substantially along the line 1—1 of FIG. 2.

Referring now to FIG. 1, there is shown a longitudinal section of an embodiment of a pump 10 of the invention which is pressure balanced both axially and radially. The pump is depicted in the form of a cartidge adapted to be placed in a cylindrical cavity, partially outlined in phantom, such that an annular discharge region 12 is formed between the pump and the wall of the cavity.

A pump housing is partially defined by housing portions 14, 16, and 18. The end housing portions 14 and 18 are constituted by discs having cylindrical hubs through which a drive shaft 20 extends. The intermediate housing portion 16, which is disposed between the outer housing portions 14 and 18, is cylindrical and has a recessed peripheral surface for defining the annular space 12 when the outer periphery of the housing engages the wall of the cavity in which the pump is mounted.

It will be noted from FIG. 1 that the interior of the drive shaft is hollow and serves as an inlet conduit for the pump 10. The right end of the drive shaft is furnished with a plurality of internal splines 22 for establishing a driving interconnection between the shaft 20 and a suitable external drive means (not shown). The shaft 20 is mounted for rotation in the housing by means of a first bearings 24, press fitted into the hub, and a second bearing 26. The second bearing includes an O-ring seal 28 which engages housing portion 18, and the housing portion 18 includes an O-ring seal 30 which engages the bearing 26. An annulus 32 on the bearing 26 is exposed to discharge pressure communicated via a leakage path between the housing portion 18 and the outer periphery of the enlarged diameter segment of bearing 26. The result of this applied pressure on the annulus 32 is to urge the bearing 26 into a shoulder 34 on the drive shaft 20, which, in turn, urges yet another shoulder 36 on the drive shaft 20 into engagement with the press fitted bearing 24. The engagement between the bearings 24 and 26 and the drive shaft 20 acts to prevent leakage therebetween, as will be appreciated by those skilled in the art.

With continued reference to FIG. 1, it will be seen that the drive shaft 20 carries a generally annular cam member 38 having two similar undulated vane cam surfaces 40 and 42 on either side thereof. Although the cam member 38 is shown as being integrally formed with the drive shaft 20, it will be understood that the cam member could be constituted by a separate structure splined or otherwise suitably attached to the drive shaft. The cam member 38, of course, rotates in unison with the drive shaft 20.

Figure 2:
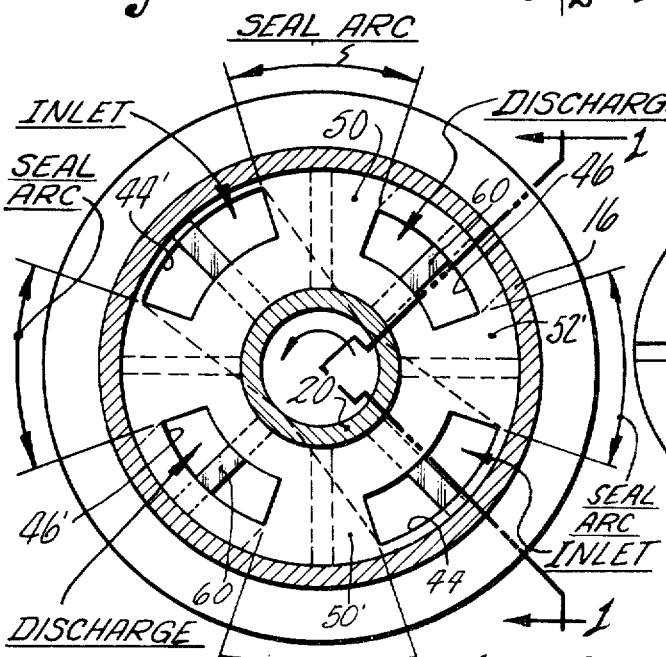
FIG. 2 is a transverse sectional view of the pump of FIG. 1, taken substantially along the line 2—2 thereof.

Referring now to FIG. 2 in conjunction with FIG. 1, the cam member is shown as having two inlet passages 44 and 44' which communicate with the hollow interior of the drive shaft 20 for receiving inlet fluid therefrom as well as with the cam surface. The cam member also has two discharge passages 46 and 46' which communicate with a circumferential outlet formed in housing portion 16 by a plurality of peripheral circumferential slots 48 which constitute the outlet of the pump 10. The slots 48 are distributed such that during rotation of the cam member 38, the discharge passages 46 and 46' are always in communication with a slot. As illustrated in FIG. 2, the inlet passages are diametrically opposed as are the discharge passages, whereby the drive shaft 20 is pressure balanced in a radial direction.

As shown in FIG. 2, the cam surface defines two opposed inlet arcs, two opposed discharge arcs, and four sealing arcs 50, 50', 52 and 52' between the inlet and discharge arcs. Over the inlet arcs (with respect to the direction of cam member rotation), the cam surfaces retreat inwardly in an inboard direction and over the discharge arcs the cam surfaces progress outwardly in an outboard direction. Sealing arcs 50 and 50' occupy fixed axial locations and sealing arcs 52 and 52' occupy fixed axial locations outboard of the sealing arcs 50 and 50'.

Figure 3:
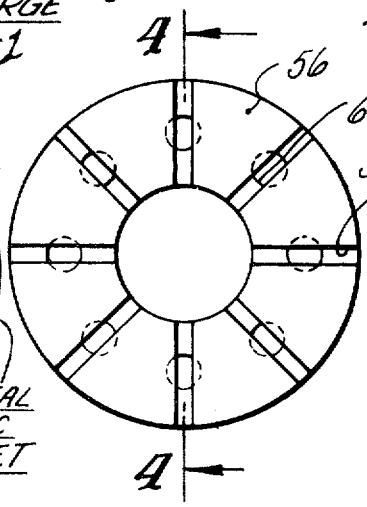
FIG. 3 is a front view of a stator, per se, without the vanes and pistons as it would appear along the line 3—3 of FIG. 1.
Figure 4:
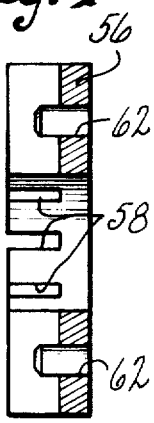
FIG. 4 is a side sectional view of a stator, per se, without the vanes or pistons, taken along the line 4—4 of FIG. 3.

Adjacent the cam surfaces are mounted fixed identical stators 54 and 56 (which constitute a part of the housing) in coaxial relationship with the drive shaft 20. As best shown in FIG. 3 and 4, the stator 56 is annular in shape and has a plurality of slots 58 formed therein in which a plurality of vanes 60 (FIGS. 1 and 2) are respectively fixedly mounted for axial sliding movement toward and away from the cam member 38, The radially extending inboard surface of the vanes are contact surfaces which engage the cam surface. Each slot communicates with a bore 62 which extends through the outboard surface of the stator 56 and has a piston 64 mounted therein for axial sliding movement. The pistons 64 are urged against the outboard sides of the vanes by springs 66, seated between the pistons and the housing portion 18. The rear surfaces of the pistons are exposed to inlet pressure communicated thereto via a plurality of respective ducts 68 which extend through housing portion 18. This pistons function to maintain the inboard surfaces of the vanes in contact with the cam surfaces until pump discharge pressure builds to a sufficient value wherein discharge pressure on the outboard surfaces of the vanes will maintain such contact. The stator 54, of course, has similar pistons and vanes.

Discharge pressure, which is directed into the slots behind the vanes via ducts 70 in housing portion 16, will (at a low pump speed) eventually drive the pistons 64 in an outboard direction out of contact with the vanes, whereby constant flexing of the springs and attendant fatigue problems will not be encountered during normal pump operation at running speeds.

Figure 5:
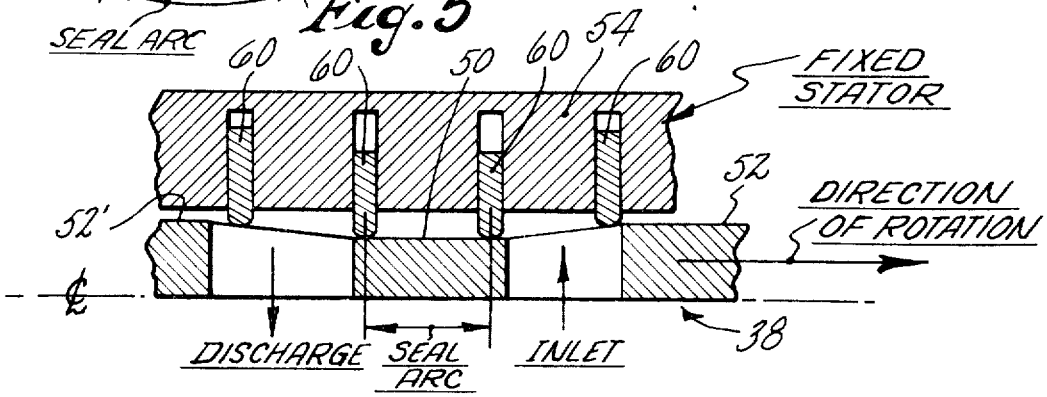
FIG. 5 is a linear representation showing the engagement between the vanes and the cam surface.

The operation of the pump 10 will be described with reference to FIGS. 1 and 5. As shown in FIG. 5, when the cam member 38 rotates an intervane volume of fluid (defined by the space between two vanes and the adjacent opposing surfaces of the cam member and the stator) increases over an inlet arc and decreases over a discharged arc, whereby fluid enters an intervane volume over an inlet arc and is expelled from an intervane volume over a discharge arc. When a sealing arc, which is preferably greater in length than the spacing between adjacent vanes, moves over a vane its axial position remains essentially unchanged. Hence, it will be appreciated that the vane pump 10 generally functions as a conventional vane pump insofar as vane-cam surface interaction is concerned.

Upon start-up, the cam surfaces 40 and 42 begin to move over the inboard contact surfaces of the vanes which are held in engagement therewith by means of the spring loaded pistons 64. Fluid from the hollow interior of the drive shaft enters the passages 44 and 44' and passes to an expanding intervane volume. Fluid from decreasing intervane volumes is expelled into passages 46 and 46'. Discharge flow proceeds from the passages 46 and 46' into the annulus 12 via the openings 48. It should be noted that the discharge pressure will be increased by centrifugal force which tends to throw the fluid in the discharge passages 46 and 48 outwardly. Of course, the inlet pressure of the fluid in passages 44 and 44' is increased over that existing in the interior of the drive shaft 20 in a similar manner.

When the discharge pressure, which is directed to the outboard surfaces of the vanes via ducts 70, increases sufficiently, pistons 64 are driven in an outboard direction out of engagement with their respective vanes. Thereafter, only discharge pressure maintains engagement between the vanes and the cam surfaces.

Because of the fact that the cam member is engaged by axially opposed arrays of vanes, the illustrated pump is pressure balanced in an axial direction. In addition, the diametrically opposed inlet and outlet passages insure a radial pressure balance.

Obviously, many modifications and variations are possible in light of the above teachings without departing from the scope and spirit of the invention as set forth in the subjoined claims.

What is claimed is:

1. A vane pump comprising:

a housing;

a cam member mounted in the housing for rotation about an axis, the cam member having an annular axial side which defines an undulated cam surface with at least one inlet arc and at least one discharge arc;

an array of vanes, each having a radially extending contact surface, fixedly mounted in the housing for axial movement parallel to the axis of rotation toward and away from the cam surface, the contact surfaces of the vanes being adapted to respectively engage the cam surface such that rotation of the cam member produces axial movement of the vanes toward and away from the cam member;

inlet passage means for directing fluid entering the pump into the volume defined between two adjacent vanes when one of the adjacent vanes is traversing an inlet arc;

discharge passage means for receiving fluid expelled from the volume between two adjacent vanes when one of the adjacent vanes is traversing a discharge arc;

a spring loaded piston mounted in the housing behind each vane to urge the vane into engagement with the cam surface, the side of the piston remote from the vane being subjected to inlet pressure and the side of the piston adjacent the vane being subjected to the pressure behind the vane; and means to direct discharge pressure behind each vane, the spring loading on the pistons being such that a discharge pressure achieved at a low pump speed is sufficient to force the pistons away from the vanes, whereby constant flexing of the springs is not encountered during normal operation.

* * * * *